US005112443A

United States Patent [19]

Virving et al.

[11] Patent Number: 5,112,443

[45] Date of Patent: May 12, 1992

[54] METHOD AND APPARATUS FOR THE MANUFACTURE OF FIBRE PULP

[75] Inventors: Nils Virving, Vällingby; Anders E. E. Havén, Tyresö, both of Sweden

[73] Assignee: Sunds Defibrator Industries Aktiebolag, Sweden

[21] Appl. No.: 669,415

[22] PCT Filed: Oct. 2, 1989

[86] PCT No.: PCT/SE89/00527

§ 371 Date: Mar. 22, 1991

§ 102(e) Date: Mar. 22, 1991

[87] PCT Pub. No.: WO90/04673

PCT Pub. Date: May 3, 1990

[30] Foreign Application Priority Data

Oct. 25, 1988 [SE] Sweden ..... 8803805

[51] Int. Cl.[5] ..... D21B 1/14; B02C 7/12

[52] U.S. Cl. ..... 162/23; 241/261.3; 241/296

[58] Field of Search ..... 241/260, 261.2, 261.3, 241/296, 297, 298; 162/23

[56] References Cited

U.S. PATENT DOCUMENTS

| | | | |
|---|---|---|---|
| 1,142,209 | 6/1915 | Van Nostrand | 241/296 |
| 3,049,307 | 8/1962 | Dalzell, Jr. | 241/296 |
| 3,149,792 | 9/1964 | Textor | 241/260 |
| 3,910,511 | 10/1975 | Leider et al. | 241/261.3 |
| 4,039,154 | 8/1977 | Peterson | 241/296 |
| 4,423,845 | 1/1984 | Frazier et al. | 241/261.3 |
| 4,712,745 | 12/1987 | Leith | 241/296 |
| 4,772,358 | 9/1988 | Virving | 162/23 |
| 4,813,621 | 3/1989 | Kleinhans | 241/261.2 |

FOREIGN PATENT DOCUMENTS

| | | | |
|---|---|---|---|
| 0883554 | 10/1971 | Canada | 241/296 |

*Primary Examiner*—Karen M. Hastings

*Attorney, Agent, or Firm*—Lerner, David, Littenberg, Krumholz & Mentlik

[57] ABSTRACT

Apparatus is disclosed for the manufacture of fiber pulp from lignocellulose-containing materials including radially extending grinding segments for use with a pair of opposed counter-rotating grinding discs in which the grinding segments include an inner radial zone with alternating raised bars and grooves projecting radially thereon parallel to the radius of the grinding segment, and an outer radial zone including a first group of alternating raised bars and grooves projecting outwardly thereon in a first direction and a second plurality of alternating raised bars and grooves projecting outwardly thereon in a second direction, both sets of these raised bars and grooves extending outwardly at angles of between about 5° and 30° with the first and second directions being opposite to each other with respect to the grinding segment itself. Methods for manufacturing fiber pulp from lignocellulose-containing material employing such grinding segments are also disclosed.

6 Claims, 1 Drawing Sheet

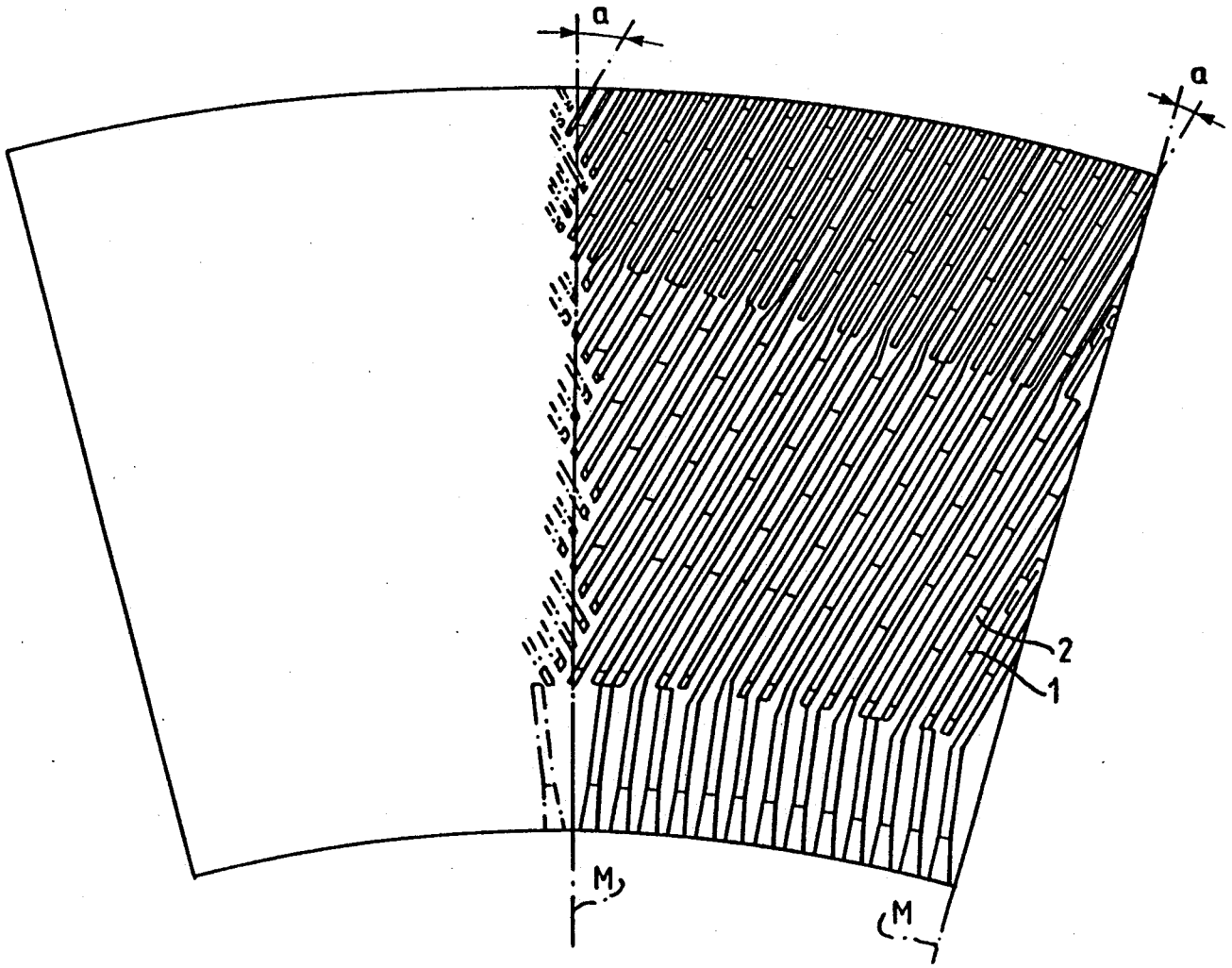
a
a
2
1
M1
M2

METHOD AND APPARATUS FOR THE MANUFACTURE OF FIBRE PULP

FIELD OF THE INVENTION

The present invention relates to methods for making fiber pulp from lignocellulose-containing material. More particularly, the present invention relates to methods for making fiber pulp from lignocellulose-containing material at torr solids contents of greater than about 15%.

Still more particularly, the present invention relates to apparatus for making fiber pulp from lignocellulose-containing material.

BACKGROUND OF THE INVENTION

The manufacture of fiber pulp from lignocellulose-containing material is generally carried out in a refiner comprising two grinding discs, at least one of which is rotary. This is generally accomplished in a manner such that the material is fed in through a central opening in one disc and disintegrated in the gap between the discs, while water is simultaneously being supplied thereto. Conventionally, the grinding discs are provided with raised bars and intermediate grooves, which extend from the center outwardly to the periphery of the grinding discs. Such methods for the manufacture of mechanical cellulose pulp have been known for a considerable period of time.

The pulps which are manufactured in such a conventional manner, however, generally contain a large fraction of relatively long fibers. In certain applications, such as for use as newsprint, this can be of value, primarily because it results in high strength, especially tear resistance, which is essential in view of the high machine speeds used during the manufacture and printing of same.

In other quality papers, such as magazine paper and LWC (light weight coated) paper, however, the printability of these papers is of greater importance, and the necessary strength in these cases is generally achieved by admixing chemical pulp therein.

Thermomechanical pulp (TMP) and chemi-mechanical pulp (CTMP) are pulps which are produced in very high yields, e.g., 90 to 95%. This implies that substantially all of the lignin remains in the pulp. The long fibers thus become rigid, and the smoothness of the paper is considerably deteriorated.

SUMMARY OF THE INVENTION

In accordance with the present invention these and other problems have been overcome by the invention of a method and apparatus which enables the manufacture of a pulp with a lower portion of long fibers, which, at the same time, is well defibered and fibrillated, and has low shives content and high bonding strength. It is thus not possible to achieve these results by the use of conventional refiner techniques. Thus, in order to reduce the long fiber content conventionally, the pulp must be reground in a separate step, at low concentration. In accordance with the present invention, however, these problems have been overcome by the cellulosic material being defibered and fibrillated by a shears-like effect between opposed bars in the two grinding discs. This is achieved in accordance herewith by the fact that the bars in the two grinding discs are arranged in both directions at a definite angle with respect to the radius of the grinding segments. Experimental evidence has thus shown that this angle should be between about 5° and 30°, preferably between about 7.5° and 22.5°.

Furthermore, in addition to the above-noted requirements with respect to pulp quality, a grinding segment is also required which can yield high production. This, in turn, requires a high capacity for transporting pulp and generating steam through the grinding zone. Furthermore, it must also be possible for rotation to take place in both directions in order to reduce the trueing of the leading bar edge by wear. It is therefore necessary for the pattern on the grinding segments to be reversible. Another requirement for the grinding segments is to contribute to the reduction of the otherwise high energy consumption by means of the pattern design itself.

There has been considerable study of the refining procedures which take place in the grinding zone itself. According to one opinion, this treatment takes place in a manner such that the chips in the grinding zone orient themselves with the fiber direction being substantially parallel with the edges of the bars of the grinding segments, which bars are conventionally oriented substantially radially thereon. During refining the chip pieces are rolled between the two grinding discs about an axis which is parallel with the direction of the fibers, and they are disintegrated to increasingly smaller particles. As a consequence, the fibers remain substantially intact in the longitudinal direction.

According to the present invention, however, when the bar edges are arranged so as to form a certain predetermined angle with respect to the radius of the segments, a shear-like effect is obtained by means of which the fibers are shorn and the long fiber content is reduced. Again, this angle is between 5° and 30°, and preferably between 7.5° and 22.5°.

Therefore, in accordance with the present invention, apparatus has been provided for the manufacture of fiber pulp from lignocellulose-containing material comprising radially extending grinding segments for use in a refiner having a pair of opposed counter-rotating grinding discs, the radially extending grinding segments including an inner radial zone and an outer radial zone, the inner radial zone including a first plurality of alternating raised bars and grooves projecting radially outwardly thereon in a direction substantially parallel to the radius of the radially extending grinding segment, and the outer radial zone including a second plurality of alternating raised bars and grooves projecting radially outwardly thereon in a first direction at an angle with respect to the radius of the radially extending grinding segment of between about 5° and 30°, and a third plurality of alternating raised bars and grooves projecting radially outwardly thereon in a second direction at an angle with respect to the radius of the radially extending grinding segments of between about 5° and 30°, the second direction being opposite to the first direction with respect to the radius of the radially extending grinding segment, whereby the pair of opposed counter-rotating grinding discs including the radially extending grinding segments can provide a shear-like effect for reduction of the long fiber content of the lignocellulose-containing material as the lignocellulose-containing material passes outwardly between the pair of opposed counter-rotating grinding discs.

In accordance with a preferred embodiment of the apparatus of the present invention, the second and third plurality of alternating raised bars and grooves project radially outwardly thereon at a plurality of different angles.

In accordance with another embodiment of the apparatus of the present invention, the first plurality of alternating raised bars and grooves in the inner radial zone comprises a number of alternating raised bars and grooves providing a first predetermined concentration of raised bars and grooves, and the second and third pluralities of alternating raised bars and grooves comprise a number of alternating raised bars and grooves providing a second predetermined concentration of raised bars and grooves, the first predetermined concentration being lower than the second predetermined concentration.

In accordance with the method of the present invention, a method for manufacturing fiber pulp from lignocellulose-containing materials has been discovered which comprises feeding the lignocellulose-containing material at a dry solids content of at least about 15% to a pair of counter-rotating grinding discs, passing the lignocellulose-containing material radially outwardly between the pair of counter-rotating grinding discs, and defibrating and fibrillating the lignocellulose-containing material by providing the pair of counter-rotating grinding discs with first and second radially extending grinding segments, each of which includes an inner radial zone and an outer radial zone, the inner radial zone including a first plurality of alternating raised bars and grooves projecting radially outwardly thereon in a direction substantially parallel to the radius of the radially extending grinding segments, and the outer radial zones including a second plurality of alternating raised bars and grooves projecting radially outwardly thereon at an angle with respect to the radius of the radially extending grinding segments of between about 5° and 30°, preferably between about 7.5° and 22.5°, whereby the lignocellulose-containing material is defibered and fibrillated by a shear-like effect between the pair of radially extending grinding segments on the pair of counter-rotating grinding discs. In a preferred embodiment, the first plurality of alternating raised bars and grooves in the inner radial zone comprises a number of alternating raised bars and grooves providing a first predetermined concentration of raised bars and grooves and a second plurality of alternating raised bars and grooves comprises a number of alternating raised bars and grooves providing a second predetermined concentration of raised bars and grooves, the first predetermined concentration being lower than the second predetermined concentration.

BRIEF DESCRIPTION OF THE DRAWINGS

In the detailed description which follows the method and apparatus of the present invention can be more fully appreciated with reference to the attached Figure, which shows a partial, elevational, view of a grinding segment for use in the method and apparatus of the present invention.

DETAILED DESCRIPTION

Referring to the Figure, a grinding segment is shown which is provided with raised bars 1 and intermediate grooves 2, which form an angle a, in the most preferred case of between 7.5 and 22.5' with respect to the radius M of the segment.

Pulp and generated steam are thus transported substantially through the grooves between the bars in the two grinding discs. This transport is powered by the centrifugal force generated by rotation of the grinding discs, and which acts in the radial direction. If all of the bars were to thus form the aforesaid angle, the discharge in certain cases would be braked to too great an extent.

According to an especially important embodiment of the present invention, the angle is therefore varied on one and the same segment within the interval stated above. In order to thus render the segment reversible, the bars are angled in both directions from the radius.

In order to prevent the chip pieces from being shorn to particles in the nature of sawdust, which would be an unfavorable shape for continued refining, and in order to simultaneously bring about an effective chip feed, the grinding segment is provided with a so-called prebreaking zone, which is located closest to the center, and in the Figure is designated with reference numeral 3. In this zone the bars are arranged substantially radially in a coarse pattern. The chip pieces are therefore split lengthwise into thinner and narrower particles.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. Apparatus for the manufacture of fiber pulp from lignocellulose-containing material comprising radially extending grinding segments for use in a refiner having a pair of opposed counter-rotating grinding discs, said radially extending grinding segments including an inner radial zone and an outer radial zone, said inner radial zone including a first plurality of alternating raised bars and grooves projecting radially outwardly thereon in a direction substantially parallel to the radius of said radially extending grinding segment, and said outer radial zone including a second plurality of alternating raised bars and grooves projecting radially outwardly thereon substantially parallel to each other in a first direction at an angle with respect to said radius of said radially extending grinding segment of between about 5° and 30° and extending entirely across said outer radial zone, whereby said lignocellulose-containing material and steam generated therein can pass outwardly across said outer radial zone, and a third plurality of alternating raised bars and grooves projecting radially outwardly thereon substantially parallel to each other in a second direction at an angle with respect to said radius of said radially extending grinding segment of between about 5° and 30° and extending entirely across said outer radial zone, whereby said lignocellulose-containing material and steam generated therein can pass outwardly across said outer radial zone, said outer radial zone thereby being substantially free of any raised bars and grooves projecting radially outwardly thereon in a direction substantially parallel to the radius of said radially extending grinding segment, said second direction being opposite to said first direction with respect to said radius of said radially extending grinding segment, whereby said pair of opposed counter-rotating grinding discs including said radially extending grinding segments can provide a shear-like effect for reduction of the long fiber content of said lignocellulose-containing material as said lignocellulose-containing material passes outwardly between said pair of opposed counter-rotating grinding discs.

2. The apparatus of claim 1 wherein said angles of said first and second plurality of alternating raised bars and grooves with respect to said radius of said radially extending grinding segments are between about 7.5° and 22.5°.

3. The apparatus of claim 1 wherein said first plurality of alternating raised bars and grooves in said inner radial zone comprise a number of said alternating raised bars and grooves providing a first predetermined concentration of raised bars and grooves, and wherein said second and third pluralities of alternating raised bars and grooves comprise a number of said alternating raised bars and grooves providing a second predetermined concentration of raised bars and grooves, said first predetermined concentration being lower than said second predetermined concentration.

4. A method for the manufacture of fiber pulp from lignocellulose-containing material comprising feeding said lignocellulose-containing material at a dry solids content of at least about 15% to a pair of counter-rotating grinding discs, passing said lignocellulose-containing material radially outwardly between said pair of counter-rotating grinding discs, and defibrating and fibrillating said lignocellulose-containing material by providing said pair of counter-rotating grinding discs with first and second radially extending grinding segments, each of said first and second radially extending grinding segments including an inner radial zone and an outer radial zone, said inner radial zone including a first plurality of alternating raised bars and grooves projecting radially outwardly thereon in a direction substantially parallel to the radius of said radially extending grinding segments, and said outer radial zone including a second plurality of alternating raised bars and grooves projecting radially outwardly thereon substantially parallel to each other at an angle with respect to said radius of said radially extending grinding segments of between about 5 and 30° and extending entirely across said outer radial zone whereby said lignocellulose-containing material and steam generated therein can pass outwardly across said outer radial zone, whereby said lignocellulose-containing material is defibered and fibrillated by a shear-like effect between said pair of radially extending grinding segments on said pair of counter-rotating grinding discs.

5. The method of claim 4 wherein said angle of said second plurality of alternating raised bars and grooves with respect to said radius of said radially extending grinding segments is between about 7.5° and 22.5°.

6. The method of claim 4 wherein said first plurality of alternating raised bars and grooves in said inner radial zone comprise a number of alternating raised bars and grooves providing a first predetermined concentration of raised bars and grooves, and where said second plurality of alternating raised bars and grooves comprise a number of said alternating raised bars and grooves providing a second predetermined concentration of raised bars and grooves, said first predetermined concentration being lower than said second predetermined concentration.

* * * * *